United States Patent [19]

Nicholson

[11] Patent Number: 4,560,969

[45] Date of Patent: Dec. 24, 1985

[54] ELECTROMAGNETIC POSITIONER FOR A SERVOVALVE OR THE LIKE

[75] Inventor: Robert D. Nicholson, Birmingham, Mich.

[73] Assignee: Bardle Servovalve Company, Birmingham, Mich.

[21] Appl. No.: 557,360

[22] Filed: Dec. 1, 1983

[51] Int. Cl.[4] ..... H01F 7/14

[52] U.S. Cl. ..... 335/272; 335/279; 137/625.64

[58] Field of Search ..... 335/229, 230, 272, 279; 137/625.62, 625.64

[56] References Cited

U.S. PATENT DOCUMENTS

| | | | |
|---|---|---|---|
| 2,794,092 | 5/1957 | Bengtsson | 200/98 |
| 2,853,090 | 9/1958 | Hanna et al. | 137/82 |
| 2,905,871 | 9/1959 | Martin | 335/272 X |
| 2,939,055 | 5/1960 | Gebhart | 317/188 |
| 3,058,038 | 10/1962 | Stedman, Jr. et al. | 317/177 |
| 3,543,648 | 12/1970 | Stahle | 91/461 |
| 3,777,784 | 12/1973 | Nicholson | 137/625.62 |
| 4,282,502 | 8/1981 | Nicholson | 335/266 |
| 4,295,594 | 10/1981 | Nicholson | 228/160 |
| 4,378,031 | 3/1983 | Nicholson | 137/625.63 |
| 4,496,134 | 1/1985 | Idogaki et al. | 335/272 X |

FOREIGN PATENT DOCUMENTS 730965 6/1955 United Kingdom .

OTHER PUBLICATIONS

Technical Bulletin N P-165 published by Pegasus, Division of Koehring Co., Berkley, Michigan, on information and belief, counsel for applicant states that said bulletin was published as aforesaid on or before Jul. 1969.

*Primary Examiner*—George Harris

*Attorney, Agent, or Firm*—Harness, Dickey & Pierce

[57] ABSTRACT

An electromagnetic positioner for positioning the drive arm of a servovalve or the like, comprising an armature extending between laterally spaced pairs of vertically disposed and vertically spaced coils for pivotal movement in a plane which includes the axes of said coils, a drive arm assembly comprising a flexure tube secured to the base or lower pole of the positioner, and extending upwardly to a position above the level of the armature, and an adapter secured at its lower end to the armature and its upper end to the upper ends of the flexure tube and drive arm so that the pivot point of the armature is adjacent but above the center of rotation of the drive arm. Also provided is a null adjusting arrangement in which the driven parts are located partly in the body of the positioner and partly in the body of the pilot valve, thereby freeing space in the positioner and reducing the height thereof. Means are provided to prevent escape from the positioner body of components of the null adjusting mechanism prior to assembly of the positioner and the related pilot valve assembly. Permanent magnets are entrapped and prevented from moving substantial distances within the positioner by studs which also secure parts of the positioner assembly and by the cover for the positioner.

5 Claims, 7 Drawing Figures

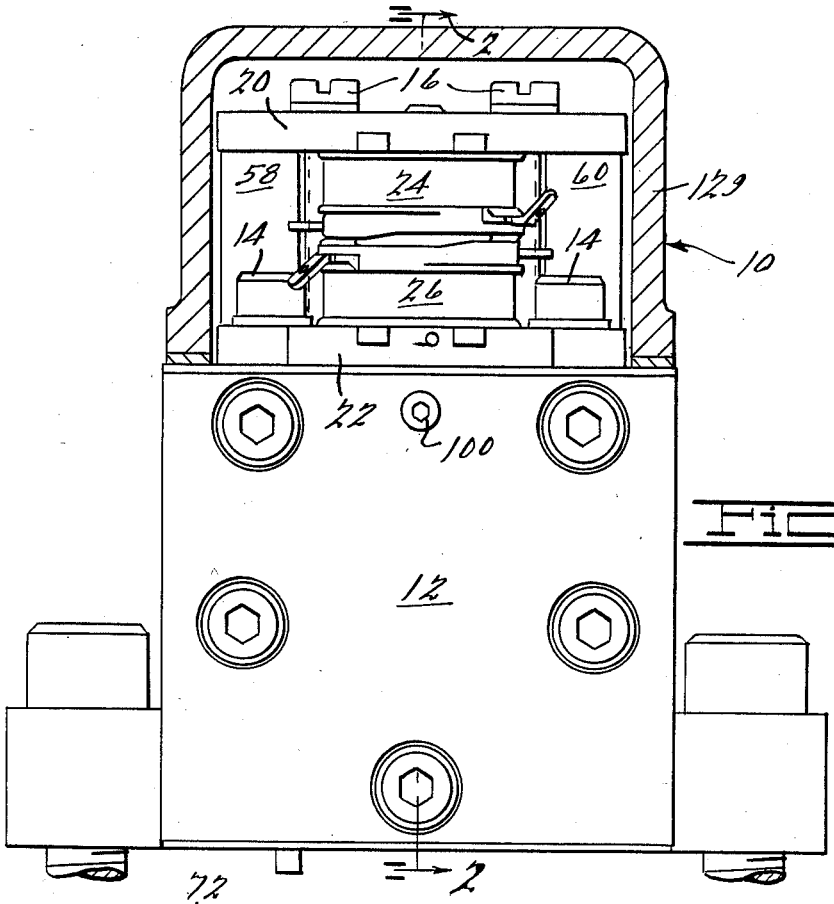
FIG. 1.
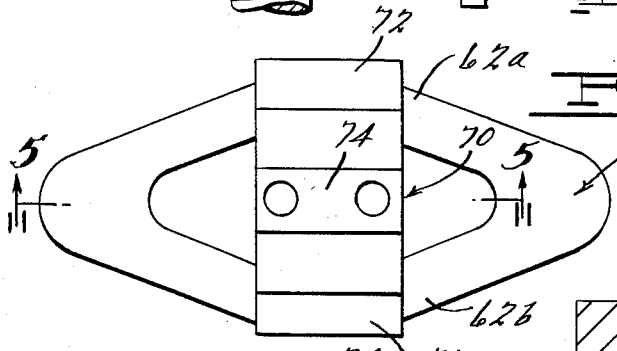
FIG. 4.
FIG. 2.
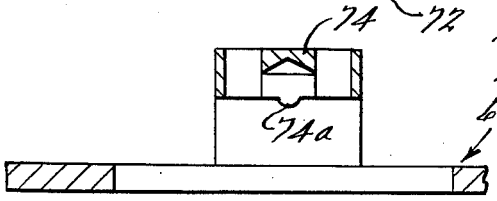
FIG. 5.
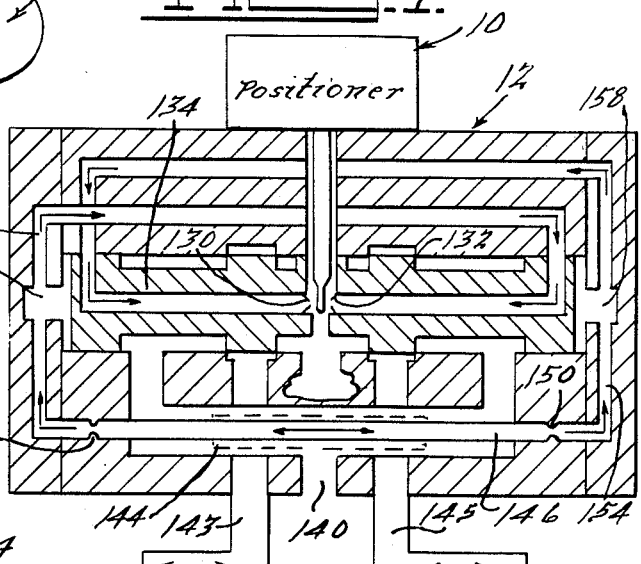
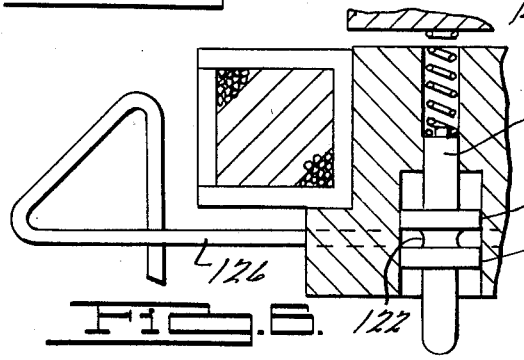
FIG. 6.

ELECTROMAGNETIC POSITIONER FOR A SERVOVALVE OR THE LIKE

BACKGROUND AND SUMMARY OF INVENTION

The present invention provides an improved electromagnetic positioner for a servovalve or the like, which through magnetic means, translates an electrical input signal into a mechanical movement of a drive arm, the extent of which movement is governed by the strength of the input signal. In a known manner, the movement of the drive arm is reinforced hydraulically and applied to the output spool of a valve having pilot and output or metering stages, which meter hydraulically moves fluid into and out of a hydraulic actuator such as a cylinder or other hydraulic motor.

The present electromagnetic positioner provides a number of mechanical features which not only improve its performance, but simplify assembly thereof, minimizes the number of parts, and consequently reduce the cost thereof.

Except in the important respects hereinafter described in more detail, the present drive arm is part of a conventionally configured drive arm assembly, comprising a usual flexure tube fixedly secured at its lower end to the base of the positioner, and having at its upper end an enlarged head to which the upper end of the drive arm is secured. Intermediate its ends, the drive arm includes a vibration damper and at its lower end the drive arm is received within the body of a related valve and is positioned between and in slightly spaced relation to the control nozzles thereof.

The flexure tube provides a pivotal mounting for the drive arm and for the armature of the positioner, which permits pivotal movements thereof about a horizontal axis positioned intermediate the upper and lower ends of the flexure tube. The direction and magnitude of pivotal movement of the armature is determined by the direction and magnitude of the incoming signal, as hereinafter described.

The armature centrally located between upper and lower vertically spaced pairs of coil assemblies, which are wired in pairs so that only four wires go to the electrical connector for the positioner. For each direction of control current, the fluxes produced by the upper coil of one and the lower coil of the other pair act in one direction upon the armature, and those produced by the remaining coils of both pairs act in the opposite direction upon the armature. The armature is also acted upon by the flux produced by two similarly oriented permanent magnets with the result that, for each direction of control current, the fluxes of one upper and one lower coil of each pair add to the magnet flux, and the fluxes of the other coils of each pair subtract from the magnet flux. This effectively doubles the magnetic, and hence the mechanical, gain of the positioner.

The armature is provided with an adapter which extends upwardly from the top of the armature to the upper end of the flexure tube, with the result that the armature is positioned at a point between the upper and lower ends of the flexure tube. This is advantageous because it enables the use of a relatively long flexure tube, which occupies most of the distance between the lower and upper ends of the coil assemblies. It also permits the axis of pivotal movement of the armature to be positioned above but relatively near the center of rotation of the drive arm. This positioning of the axis of pivotal movement is advantageous because it lowers the natural frequency of the sprung mass of the drive arm assembly and reduces sensitivity to lateral accelerations of the lower end of the drive arm. This lowered sensitivity and reduced natural frequency also permit use of a lighter weight vibration damper or counterweight which may be formed of less expensive materials than would otherwise be the case.

The present invention also provides an improved null adjusting arrangement, certain of the movable elements of which are positioned within the body of the positioner and the remainder whereof are positioned within the pilot and metering valve body, and so do not take up space within the positioner. Another feature of the invention is the provision of a simple arrangement for preventing escape of parts of the null adjusting assembly prior to the bringing together of the respective positioner and valve bodies.

In order to simplify and facilitate the assembly of the various components of the positioner, the present arrangement enables the several components of the positioner to be freely positioned within the positioner body until the assembly thereof is completed by studs which extend through the upper pole and are threadably received by threaded openings provided in the lower pole.

Further advantages and improvements provided by the present invention will appear from the illustrations and explanation of a preferred embodiment thereof.

BRIEF DESCRIPTION OF THE DRAWINGS

FIG. 1 is a view in front elevation of the present positioner and certain parts of the related pilot and metering valve body;

FIG. 4 is a view in top plan of the armature and adapter assembly;

FIG. 5 is a view in vertical central section taken along the line 5—5 of FIG. 4;

FIG. 6 is a fragmentary view showing a retainer for certain parts of the null adjusting elements, at an intermediate state of an assembly process; and FIG. 7 is a diagrammatic view of the positioner and related servovalve, and hydraulic motor served thereby.

DETAILED DESCRIPTION OF THE PREFERRED EMBODIMENT

Figure 2:
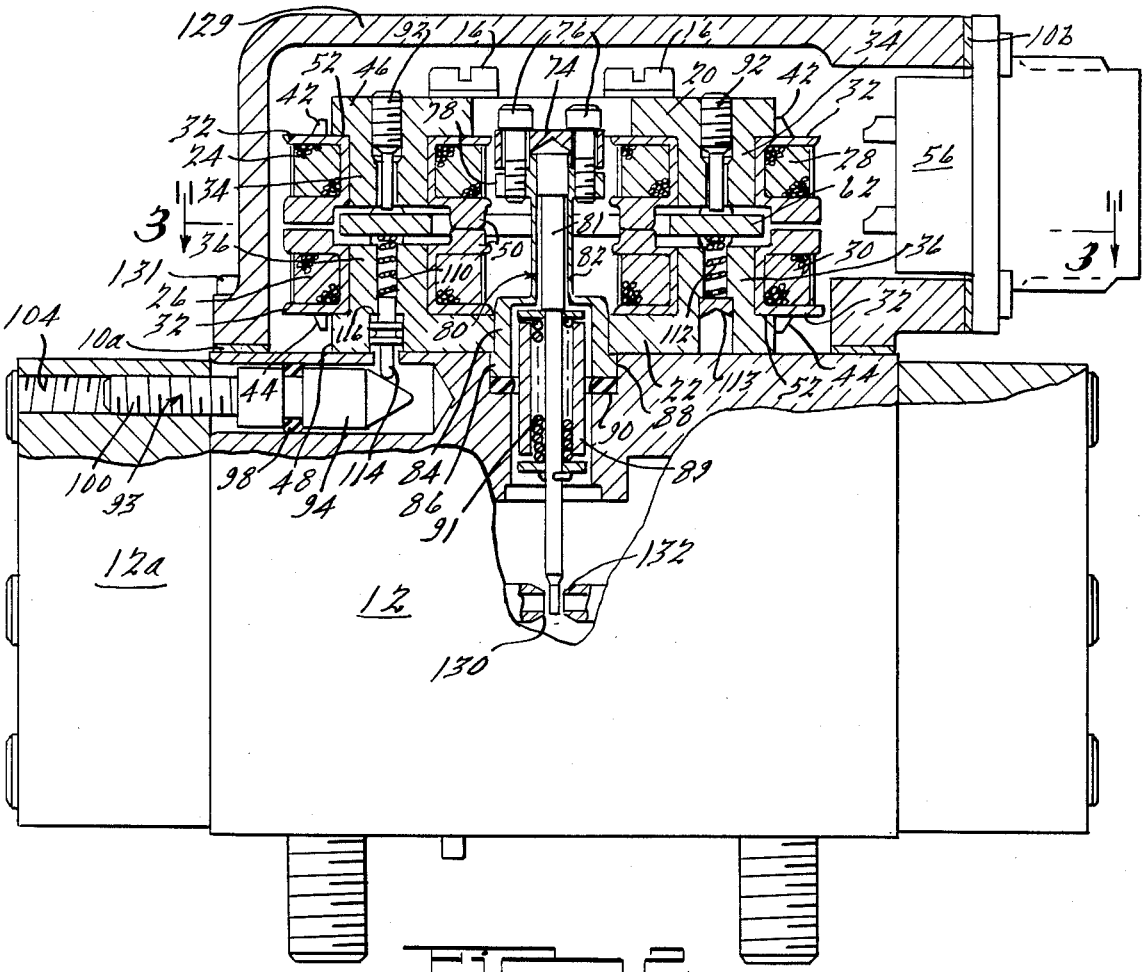
FIG. 2 is a view taken along the line 2—2 of FIG. 1.
Figure 3:
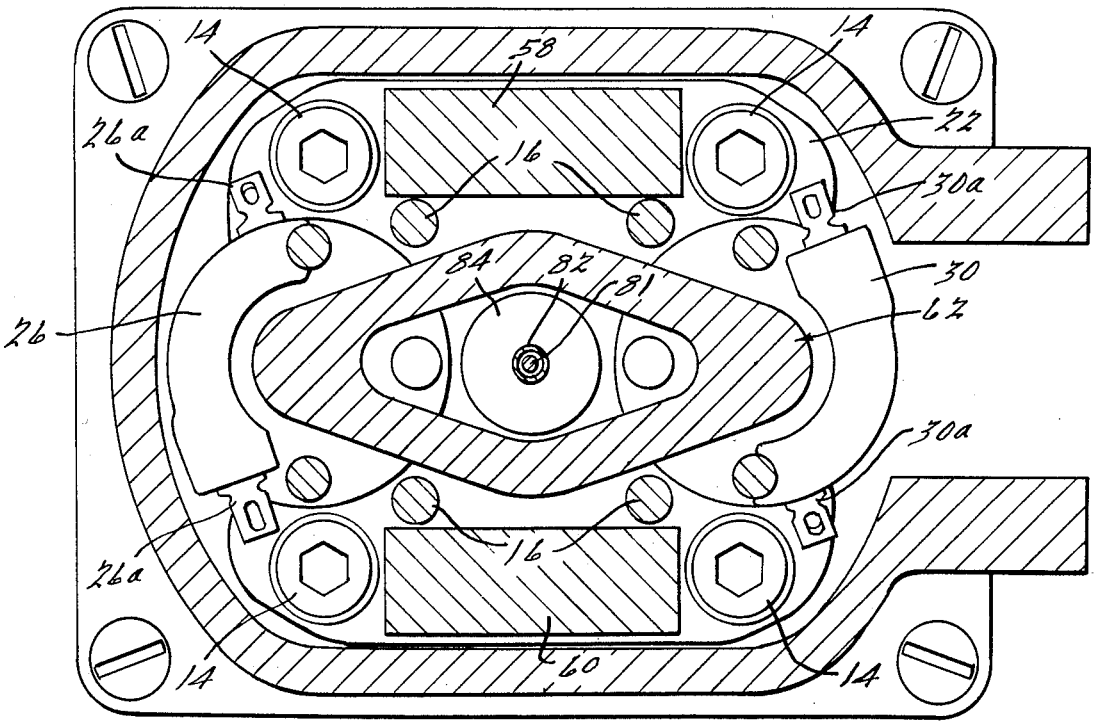
FIG. 3 is a view in horizontal section taken along the line 3—3 of FIG. 2.

Referring now to FIGS. 1, 2 and 3, the positioner, designated as a whole as 10, is secured upon the upper surface of the pilot and metering valve body 12, by studs 14 (FIGS. 1 and 3) which project downwardly through apertures provided in the lower pole 20 and are threadably received in threaded openings (not shown) provided therefor in the upper surface of the valve body 12.

Electrically conductive coils 24, 26, 28 and 30 are carried by moulded coil forms individual thereto which are duplicates of each other and are designated 32. Forms 32 are snugly but freely received within the downwardly projecting extensions 34 of the upper pole 20 and the upwardly projecting extensions 36 of the lower pole 22. Upwardly projecting tabs 42 and downwardly projecting tabs 44 abut the ends 46 and 48 of the upper and lower poles 20 and 22 and inhibit rotative movement of the coil assemblies.

Co-engaging downwardly and upwardly extending, circumferentially spaced, tabs 50 carried by the coil forms prevent relative vertical movement of the upper and lower coil assemblies, and also hold the upper and lower coil assemblies in engagement with the shoulders 52 formed on the respective lower and upper surfaces of poles 20 and 22.

The coils 24 and 26 are connected in series with each other and the same is true of the coils 28 and 30. With this arrangement only four wires go to the electrical connector. Terminals 26*a* and 30*a* for coils 26 and 30 are shown in FIGS. 1 and 3. The four conductors extending between the coil terminals and the electrical connector 56 are omitted in order to simplify the drawings.

As best seen in FIGS. 1 and 3, the permanent magnets 58 and 60, which may be and preferably are made of the alloy sold under the tradename "Alnico" extend between, are tightly held between the upper and lower poles 20 and 22, and are positioned on respectively opposite sides of the armature 62. As aforesaid, armature 62 extends horizontally midway between the respective upper and lower poles and is mounted for limited pivotal movement about a horizontal axis positioned midway between the ends of the armature. The components of the positioner are held in assembled relation by studs 16, which extend through openings provided therefor in the upper pole and at their lower ends are threadably received in threaded openings provided therefor in the lower pole.

Magnets 58 and 60 are polarized so that when control current flows in one direction through the upper and lower pairs of coils 26 and 28, and 30 and 32, respectively, the magnet flux adds to the coil fluxes of one upper and one lower coil 24 and 26 for example, and subtracts from the flux generated by the remaining two coils 28 and 30. As aforesaid, this effectively doubles the magnetic, and hence the mechanical, gain of the positioner. As will be obvious, flux produced by the two upper coils flows through the armature and through the upper pole 20. Flux produced by the two lower coils flows through the armature and through the lower pole 22.

As will be appreciated, the flux generated for example by the left-hand permanent magnet 58 in FIG. 1, extends across the magnetically tight joints between the upper end of the magnet and the undersides of the right and left hand ends of the upper pole 20, through the body of the pole and thence down through the left and right hand pole extensions 34 (FIG. 2), across the two air gaps above and below the ends of the armature 62 and thence downwardly through the extensions 36 of the lower pole 22 and back into the body of the magnet 58.

As shown in FIG. 3 the armature 62 is of an elongated oval shape and bridges the gap between the left and right hand coil assemblies, as viewed in FIGS. 2 and 3. It is preferably made of relatively soft, very low hysteretic material, such as one-half nickel, and one-half iron. As most clearly appears in the subassembly shown in FIGS. 4 and 5, the previously mentioned adapter 70 is of downwardly presenting bridgelike form. The lower ends of the laterally spaced arms 72 rest upon and are suitably secured, preferably but not necessarily by gluing, to the laterally extending legs 62*a* and 62*b* of the armature 62. The elevated central portion 74 of the adapter 70 is thickened and (FIG. 3) is secured by longitudinally spaced studs 76 to the enlarged head 78 of the flexure tube 80. The adapter 7 does not require as low a hysteresis effect as does the armature 62, and consequently it is preferably formed from an alloy of aluminum or the like having good surface characteristics and also able to provide a more stable pivot point for the drive arm than could be provided by the relatively soft material from which the armature is made.

Below the flexure tube a counterweight 89 is statically fastened to the drive arm 81 through an elastomer 91. Dynamically, the counterweight decouples and serves as an inertial vibration damper. It is illustrated as being of usual construction except that the previously mentioned reduced acceleration sensitivity and reduced natural frequency provided by the present invention permits use of a lighter weight counterweight which may be formed of less expensive materials than would otherwise be the case.

The body 82 of the flexure tube extends downwardly from the head 78 and terminates in two downwardly presenting circular cup-shaped members 84 and 86. The lower end of member 84 is tightly fitted within an opening provided therefor in the lower pole 22 and secures the drive arm assembly to the stationary components of the positioner. The lower end of member 86 is tightly received within an upwardly presenting recess 88 provided therefor in the upper surface of the valve body 12 and, with studs 14, secures the positioner to the body 12. An "O" ring 90 or other suitable means is interposed between the lower end of the enlargement 86 and the base of the recess 88 and prevents leakage of hydraulic fluid from the valve assembly into the interior of the positioner.

Preferably the flexure tube is fabricated from copper alloyed with a small amount of beryllium, which when properly age hardened, provides the desirable properties of low hysteresis, and good fatigue and flexure strength. These properties are very desirable because the allowable bending stress in the flexure tube determines the maximum stroke of the positioner.

In accordance with usual practice, each of the upper air gaps between the armature 62 and the lower ends of the two pole extensions 34 of the upper pole 22, contains a solid stop which is set just outside the operating range of the armature. As will be understood, this prevents damage to the positioner from excessive applied currents and also precludes the armature from latching onto one of the poles. The amount of control current that is permissible is limited only by the thermal capacity of the coils. The stops are provided by threaded studs 92 which are received in threaded passages provided therefor in the upper pole 20. Means of retaining this setting is preferably provided such as a deformed thread in the threaded passage.

In accordance with the present invention, null adjustments are effected by a null adjust screw 93 which as aforesaid is positioned within the body of the valve 12, and so does not require space within the positioner. The enlarged head 94 of the null adjust screw 93 is slidable within a recess provided therefor in the valve body 12. An environmental seal for the positioner cavity is provided by a usual "O" ring 98. Gaskets 10*a* and 10*b* complete this environmental seal.

The reduced left hand end portion 100 of the adjust screw 93 is threadably received within a threaded passage in an open ended recess 104 provided in the end cap 12*a* of the valve body 12. The screw 93 can be operated by inserting a hex key into the open end of the portion 100. As indicated above, this setting may be secured as by a deformed thread. Recess 104 is smaller than the head 94 and prevents escape of screw 93.

The air gaps below the armature 62 carry low rate springs 110 and 112 which are received within axial passages formed in the pole extensions 36 provided in the lower pole 22. The passage for spring 110 opens into a recess 116 which contains a push-rod 114, the upper end of which seats against the lower end of the spring 110, and the lower rounded end of which rides against the conical lower end of the adjusting screw 93. The passage for the other spring 112 is closed at its lower end by plug 113.

As will be understood, rotation of screw 93 raises or lowers the member 114 and either increases or decreases the loading of spring 110. The resultant change in the relative pressures exerted against the undersides of the ends of the armature by springs 110 and 112 causes armature 62 to move in a direction to either eliminate or, if desired, produce a non-coincidence of the hydraulic and electric nulls.

A further feature of the invention is the provision of means to prevent escape of the push-rod 114 prior to the mounting of an assembled positioner 10 upon the valve 12. More particularly, as appears in FIG. 6, the lower pole 22 is provided with a small horizontally extending passage which intersects the lower enlarged portion of the recess 116. Push-rod 114 in turn is provided with a necked down portion in the area between two lands thereon. A light wire 126 is dimensioned to freely pass through the recess 116 and engage the necked down area 122 of the push-rod 114. As will be understood, when the positioner has been secured to the valve body 12, the wire 126 can be withdrawn thereby freeing the push-rod 114 for movement downwardly into engagement with the conical nose of the adjusting screw 93.

Considering now the simplified assembly procedures which characterizes the present invention, and with particular reference to FIG. 3, it will be appreciated that the permanent magnets 58 and 60, both of which are of simple rectangular elongated form, are initially in an uncharged condition, and so may freely be placed upon the upper surface of the lower pole 22 after the flexure tube, drive arm and vibration damper have been assembled to it. Before or after the magnets are in place, the studs 14 may be freely passed through the holes provided therefor in the lower pole 22. The two lower coil assemblies may be slid down over the pole extensions 36 of the lower pole and turned to the rotative position in which the downwardly projecting lower tabs 44 engage against the corresponding faces of the lower pole 22.

With the parts thus preliminarily positioned, the assembly comprising the armature 62 and the adapter may be lowered into place, and attached with the screws 76.

With the armature 62 in place, the upper pole 20 and the upper coil assemblies 24 and 28 may be moved into place and the coil assemblies rotated to proper position. This action enables the studs 16 to be passed through the openings provided therefor in the upper pole and threaded into the openings provided therefor in the lower pole and torqued into place. Before torquing the studs into place the magnets 58 and 60 may of course be moved into proper positions as shown.

Thereafter the assembled positioner may be placed within a charging fixture and both magnets 58 and 60 brought to the fully charged condition. When this has been done the positioner is ready for installation upon an associated pilot valve body and the enlargement 86 fitted into place in recess 88, above the O-ring. Assembly is completed by threading the studs 14 into place. As soon as this is done the anti-escape wire 126 can be withdrawn permitting the push-rod 114 to fall into engagement with the null adjusting screw 93. Thereafter the cover 129 may be moved into place and secured by studs 131, which are positioned around the base of the cover.

It is to be expected that in service, the present positioner, its related pilot and metering valves and the hydraulic motor controlled thereby, will be subject to severe and sustained vibration, which in extreme cases may cause the studs 16 to become loosened. With the entrapping arrangement of the present invention, such loosening would permit only a very limited movement of the magnets 58 and 60 with respect to the upper and lower poles 20 and 22. Such movement to the left or right as viewed in FIG. 3 is substantially prevented by the immediately adjacent enlarged heads of the studs 14. In turn, the bodies of the studs 16 prevent substantial movements of the magnets toward the center of the positioner and the immediately adjacent walls of the cover 129 prevents substantial outward movement of the magnets. Thus, the entrapment of the magnets makes possible the simple elongated rectangular form thereof, avoids machining operations thereon, and permits the use of magnet materials of superior retentivity without corresponding increases in cost.

As will be understood, the present positioner is suitable for use as a part of any of a variety of known feedback servovalves, having metering and pilot valve stages. Such pilot stages act as hydraulic amplifiers and reinforce the motion of the drive arm and tip. Conventionally, they include opposed control nozzles which act to keep the drive arm of the positioner centered between the nozzles, forcing the metering spool to mimic the motion of the drive arm with negligible loading.

The pilot and metering stages of a well known servovalve construction are diagrammatically shown in FIG. 7, in which the positioner 10 is positioned on top, and the drive arm extends downwardly into the space between the two pilot nozzles 130 and 132.

Hydraulic fluid admitted through the inlet 140 at a pressure suitable for use by the hydraulic motor 142, passes through the usual strainer where it divides and flows at the same rate through the two passages 144 and 146. The pressure is reduced at 148 and 150 to a value suitable for control purposes. Thereafter, the hydraulic fluid continues through passages 152 and 154 to the respective nozzles 132 and 130. Pressure in passages 152 and 154 is also applied through passages 156 and 158, to the respectively opposite ends of the spool 134.

In the typical arrangement of FIG. 7, under inactive conditions, the pilot nozzles are centrally located within the metering spool 134 and the tip of the drive arm is centered between the nozzles 130 and 132. Under these conditions, the hydraulic pressures acting at opposite ends of the spool 134 are equal, the rates of flow through the nozzles 130 and 132 are the same, and spool 134 is in a centered, blocking position.

As will be understood, independent motion of either the metering spool 134 or of the tip of the drive arm 81 will cause a change in the relative restrictions to flow through the two control nozzles 130 and 132 which will create an imbalance in the pressures acting on the respective ends of the metering spool, causing the spool to move in a direction to reduce the imbalance. Thus the pilot stage acts to keep the drive arm centered between the nozzles, and as aforesaid, forces the spool to mimic the motion of the drive arm.

To illustrate the operation of the positioner and the related pilot and metering valves, it may now be assumed that a signal current is supplied to the coils 24, 26, 28 and 30, in one direction or another, and ranging in value from a very low value to the maximum which the positioner is designed.

As previously described, this flow of current increases the magnetic force supplied at one end of the armature 62 and correspondingly decreases the magnet force supplied at the other end of the armature 62. These forces are transmitted through the adapter 70 to the upper end of the flexure tube 80 and cause the latter to tilt to a corresponding degree about a horizontal axis which lies midway between the right and left hand end of the armature as viewed in FIG. 3.

This motion of the flexure tube is of course resisted by the resistance to bending thereof. It also tilts the drive arm, thereby altering the relative rates of flow through nozzles 130 and 132 and consequently unbalancing the pressures now being applied to the respectively opposite ends of the metering spool 134 and causing it to move in a direction to reduce the imbalance.

The motion of the tip of the drive arm continues as a series of oscillations of progressively decreasing amplitude, as influenced by the damper 90, until the unbalanced forces acting on the metering valve disappear, at which time the tip of the drive arm again occupies a position midway between the two control nozzles 130 and 132. This steady state condition is attained when the metering spool has been displaced an amount determined by the degree of excitation initially applied to the coils 24, 26, 28 and 30.

As will be obvious, the metering spool and the valve body provide a conventional four-way valve through which hydraulic fluid is supplied in one direction or the other through passages 143 and 145 to the respective ends of a usual hydraulic motor 142. These flows of hydraulic fluid continue at a rate determined by the displacement of the metering spool so long as the current supply to the coils 24, 26, 28 and 30 continues. If that current is interrupted or varied, the tip of the drive arm will either return to its center position thereby stopping the hydraulic motor 142, or causing the motion to continue at a rate and in a direction determined by the degree and direction of the change. While there are many variations available to suit particular applications, the great majority of output stages are arranged to yield a proportional relationship between input current and output flow.

While a preferred embodiment of the present invention has been disclosed herein in detail, it will be understood that other embodiments and modifications thereof are possible within the spirit and scope of the appended claims.

What is claimed is:

1. An electromagnetic positioner for a servovalve, or the like, comprising selectively energizable magnetic means, a magnetizable armature positioned for pivotal movement in response to magnetic force exerted thereon by said magnetic means, a flexure tube fixedly supported at its lower end and projecting upwardly to a position in which the upper end thereof is above said armature, a drive arm, and means for supporting said armature for movement about a horizontal axis adjacent but above the center of rotation of said drive arm, said means including an upwardly extending adapter secured at its lower end to the armature, and means for securing the upper ends of the drive arm and of the flexure tube to the upper end of said adapter.

2. An electromagnetic positioner for a servovalve, or the like, comprising at least one pair of electrically conductive coils laterally spaced from each other and having their axes vertical, an armature positioned between the respective coils and spanning the distance therebetween, said armature being pivotally movable in a vertical plane which includes the axes of said coils in response to magnetic forces acting thereon, a flexure tube fixedly supported at its lower end and projecting upwardly into the space between said coils to a position in which the upper end thereof is above said armature, a drive arm, and means for supporting said armature movement about a horizontal axis adjacent but above the center of rotation of said drive arm, said means including an upwardly extending adapter secured at its lower end to the armature, and means for securing the upper ends of the flexure tube and of said drive arm to the upper end of said adapter.

3. An electromagnetic positioner for a servovalve, or the like, including at least one pair of electrically conductive coils having their axes vertical and being vertically spaced from each other, an armature positioned between the respective coils and pivotally movable in response to magnetic forces produced by said coils, a flexure tube fixedly supported at its lower end and projecting upwardly to a position in which the upper end thereof is above said armature, a drive arm and means for supporting said armature for movement about a horizontal axis adjacent but above the center of rotation of said drive arm, said means including an upwardly extending adapter secured at its lower end to the armature, and means for securing the upper ends of the drive arm and of the flexure tube to the upper end of said adapter.

4. An electromagnetic positioner for a servovalve, or the like, comprising two pairs of electrically conductive coils laterally spaced from each other, the coils of each pair having their axes vertical and being vertically spaced from each other, an armature positioned between the respective pairs of coils and spanning the distance between said respective pairs, a flexure tube fixedly supported at its lower end and projecting upwardly into the space between said two pairs of coils to a position in which the upper end thereof is above said armature, a drive arm, and means for supporting said armature movement about a horizontal axis adjacent but above the center of rotation of said drive arm, said means including an upwardly extending adapter secured at its lower end to the armature, and means for securing the upper ends of the flexure tube and of the drive arm to the upper end of said adapter.

5. An electromagnetic positioner for a servovalve, or the like, comprising two pairs of coils laterally spaced from each other, the coils of each pair having their axes vertical and being vertically spaced from each other, means for supplying exciting current to said coils, permanently magnet means for uni-directionally energizing both pairs of coils, a magnetizable armature positioned between the respective coils of each pair and spanning the distance between the respective pairs, said armature being pivotally movable in response to magnetic force exerted thereon, and means for interconnecting said coils so that when exciting current flows in one direction through the upper coil of one pair and the lower coil of the other pair it flows in the other direction through the remaining said coils, whereby for each direction of current flow, the fluxes produced by two of the coils add to the permanent magnet flux in two of the air gaps and subtract from the permanent magnet flux in the remaining two air gaps.

* * * * *